United States Patent [19]

Yamato et al.

[11] Patent Number: 4,478,194

[45] Date of Patent: Oct. 23, 1984

[54] FUEL SUPPLY CONTROL METHOD FOR INTERNAL COMBUSTION ENGINES IMMEDIATELY AFTER CRANKING

[75] Inventors: Akihiro Yamato, Shiki; Akihiko Koike, Urawa; Takehiko Hosokawa; Nobutoshi Maruyama, both of Yokohama, all of Japan

[73] Assignee: Honda Motor Co., Ltd., Tokyo, Japan

[21] Appl. No.: 524,898

[22] Filed: Aug. 19, 1983

[30] Foreign Application Priority Data

Aug. 25, 1982 [JP] Japan ..... 57-147234

[51] Int. Cl.[3] ..... F02D 5/02

[52] U.S. Cl. ..... 123/491; 123/179 L

[58] Field of Search ..... 123/478, 480, 488, 491, 123/179 L

[56] References Cited

U.S. PATENT DOCUMENTS

| | | | |
|---|---|---|---|
| 3,969,614 | 7/1976 | Moyer et al. | 123/480 X |
| 4,193,380 | 3/1980 | Marchak et al. | 123/480 X |
| 4,227,491 | 10/1980 | Schnurle et al. | 123/491 X |
| 4,313,412 | 2/1982 | Hosaka et al. | 123/486 X |
| 4,436,073 | 3/1984 | Miyagi | 123/480 X |

*Primary Examiner*—Tony M. Argenbright

*Attorney, Agent, or Firm*—Arthur L. Lessler

[57] ABSTRACT

A fuel supply control method for electronically controlling the quantity of fuel being supplied to an internal combustion engine in synchronism with generation of pulses of a predetermined control signal, in response to a fuel increment gradually decreasing in value after termination of cranking of the engine. Immediately when the engine leaves a cranking state, an initial value of the fuel increment is set, which corresponds to a product obtained by multiplying the value of a fuel increasing coefficient decreasing in value as the engine temperature increases by the value of a coefficient being a function of the engine temperature. Subsequently, the thus set initial value of the fuel increment is decreased upon generation of each pulse of the above predetermined control signal until the thus decreased incremental value becomes equal to a value at which no substantial increase takes place in the fuel quantity being supplied to the engine.

4 Claims, 9 Drawing Figures

FUEL SUPPLY CONTROL METHOD FOR INTERNAL COMBUSTION ENGINES IMMEDIATELY AFTER CRANKING

BACKGROUND OF THE INVENTION

This invention relates to a control method for electronically controlling the quantity of fuel being supplied to an internal combustion engine immediately after cranking thereof, and more particularly to such a control method which is adapted to supply the engine with desired increased quantities of fuel responsive to a fuel increment gradually decreasing in value from an initial value thereof set in dependence on the engine temperature after termination of cranking of the engine, thereby to achieve smooth and stable engine operation.

Among conventional fuel quantity control methods for internal combustion engines, it has been widely known as starting fuel supply control to control the fuel quantity to an appropriate value corresponding to the cooling water temperature of the engine representative of the engine temperature at cranking of the engine so as to ensure positive and smooth starting of the engine, while it has also been known as basic fuel supply control to control the fuel quantity to a value dependent upon operating parameters of the engine such as engine rotational speed and intake pipe absolute pressure after the engine has got out of the cranking state. In this basic fuel supply control, increase of the fuel quantity is effected by the use of a fuel increasing coefficient decreasing in value as the engine cooling water temperature increases (hereinafter called "the water temperature-dependent fuel increasing coefficient KTW"), so as to achieve stable engine operation while the engine is in a cold state.

In order to obtain smooth transition from cranking operation of the engine under the above starting fuel supply control to normal operation of same under the above basic fuel supply control, it has been proposed by the assignee of the present application to set a value of an after-start fuel increasing coefficient KAST as a product of the value of the above water temperature-dependent fuel increasing coefficient KTW and a constant CAST' having a fixed value, set a fuel quantity being supplied to the engine immediately after cranking thereof on the basis of the above set value of the fuel increasing coefficient KAST, and subsequently gradually decrease the set fuel quantity to be supplied to the engine (Japanese Provisional Patent Publication No. 57-206737).

The rate of increase of the fuel supply quantity for obtaining smooth and positive startability of the engine according to the aforementioned starting fuel supply control at cranking is larger than that of the fuel supply quantity for obtaining stable engine operation according to the aforementioned basic fuel supply control. Therefore, if the fuel quantity being supplied to the engine immediately after cranking is set on the basis of the value of the coefficient KAST obtained by multiplying the value of the water temperature-dependent fuel increasing coefficient KTW by the constant CAST' having a fixed value according to the above proposed after-cranking fuel supply control method, there can occur a large difference in the resulting fuel supply quantity between at cranking and immediately after the cranking. This large difference can cause a degradation in the driveability of the engine to give an unpleasant feeling to the driver, and can even cause engine stall.

SUMMARY OF THE INVENTION

It is the object of the invention to provide an electronic fuel supply control method for internal combustion engines, which is adapted to supply properly increased quantities of fuel in a manner gradually decreasing from an initial fuel quantity set in dependence on the engine cooling water temperature to the engine during transition from a cranking operation to a normal operation after the cranking, thereby ensuring smooth and stable driveability of the engine.

According to the invention, there is provided a method of electronically controlling the quantity of fuel being supplied to an internal combustion engine in synchronism with generation of pulses of a predetermined control signal, in response to a fuel increment having a value thereof gradually decreasing after termination of cranking of the engine. The method according to the invention is characterized by comprising the following steps: (1) determining whether or not the engine is in a cranking state; (2) setting an initial value of the above fuel increment, which corresponds to a product obtained by multiplying the value of a fuel increasing coefficient having a value thereof decreasing as the temperature of the engine increases by the value of a coefficient being a function of the engine temperature, immediately upon determination that the engine has left the cranking state; (3) subsequently decreasing the thus set initial value of the fuel increment upon generation of each pulse of the above predetermined control signal until the thus decreased incremental value becomes equal to a value at which no substantial increase takes place in the fuel quantity being supplied to the engine.

The above coefficient as a function of the engine temperature has a value thereof increasing as the engine temperature decreases.

Preferably, the above step (1) comprises determining that the engine is in the cranking state when the starter switch of the engine is in a closed position and simultaneously the rotational speed of the engine is lower than a predetermined value.

The above and other objects, features and advantages of the invention will be more apparent from the ensuing detailed description taken in conjunction with the accompanying drawings.

BRIEF DESCRIPTION OF THE DRAWINGS

FIG. 9 is a graph showing a table of the relationship between the first cooling water temperature-dependent fuel increasing coefficient KTW.

DETAILED DESCRIPTION

The method of the invention will now be described in detail with reference to the drawings.

Figure 1:
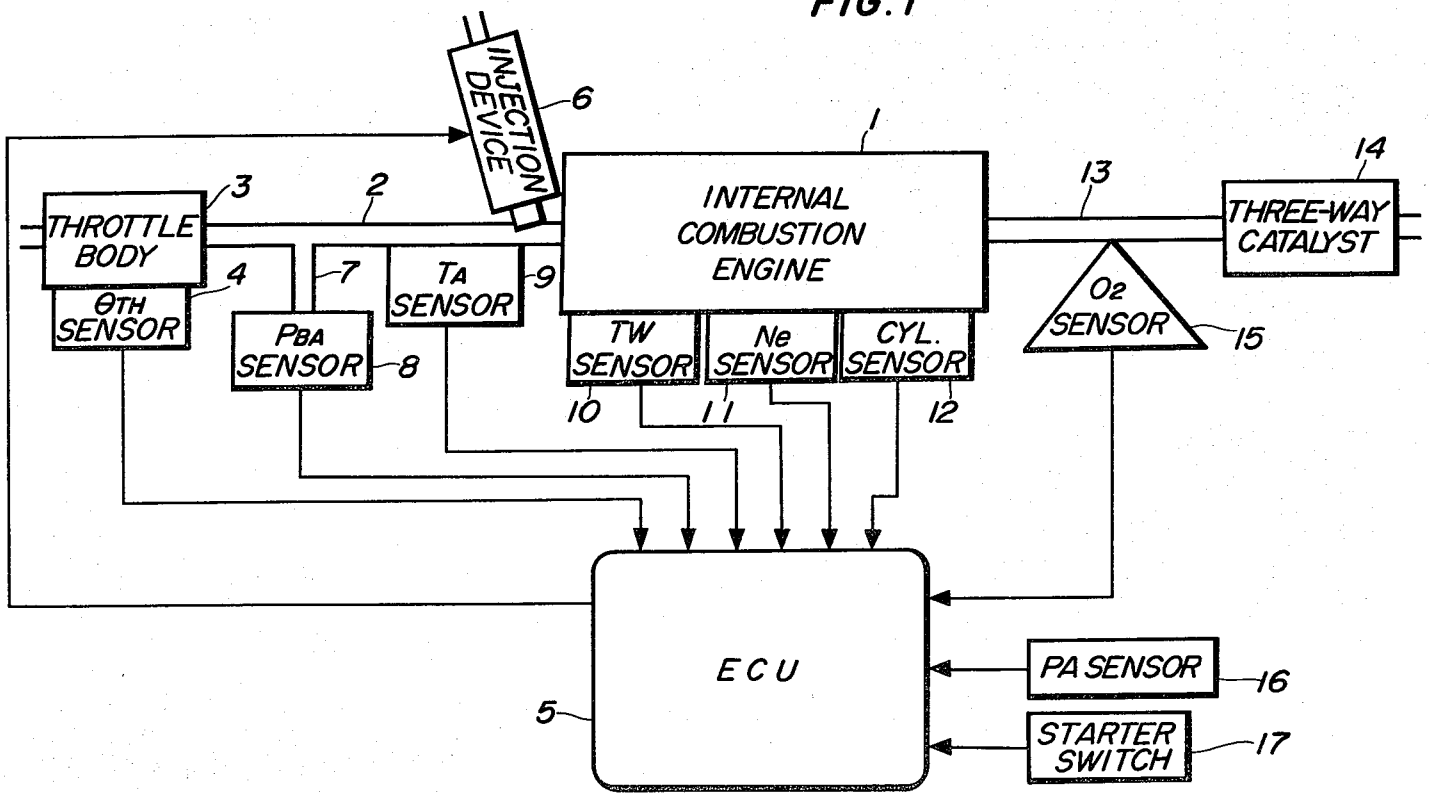
FIG. 1 is a block diagram illustrating the whole arrangement of a fuel supply control system to which is applicable the method according to the invention.

Referring first to FIG. 1, there is illustrated the whole arrangment of a fuel supply control system for internal combustion engines, to which the method of the invention is applicable. Reference numeral 1 designates an internal combustion engine which may have four cylinders, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake piep 2 is a throttle body 3 which accommodates a main throttle valve and a sub throttle valve mounted in the main intake pipe and the sub intake pipe, respectively, for synchronous operation. Neither of the two throttle valves is shown. A throttle valve opening ($\theta$th) sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the sub-injector, which is single in number, is arranged in the sub intake pipe at a location slightly downstream of the sub throttle valve, for supplying fuel to all the engine cylinders. The fuel injection device 6 is connected to a fuel pump, not shown. The main injectors and the subinjector are electrically connected to the ECU 5 in a manner having their valve opening periods or fuel injection quantities controlled by signals supplied from the ECU 5.

On the other hand, an absolute pressure (PBA) sensor 8 communicates through a conduit 7 with the interior of the main intake pipe of the throttle body 3 at a location immediately downstream of the main throttle valve. The PBA sensor 8 is adapted to detect absolute pressure in the main intake pipe 2 and supplies an electrical signal indicative of detected absolute pressure to the ECU 5. An intake air temperature (TA) sensor 9 is mounted in the main intake pipe at a location downstream of the PBA sensor 8 for supplying an electrical signal indicative of detected intake air temperature to the ECU 5.

An engine cooling water temperature (TW) sensor 10, which may be formed of a thermistor or the like, is mounted on the main body of the engine 1 in a manner embedded in the peripheral wall of an engine cylinder 1 having its interior filled with cooling water, an electrical output signal of which is supplied to the ECU 5.

An engine rpm (Ne) sensor 11 and a cylinder-discriminating sensor 12 are arranged in facing relation to a camshaft, not shown, of the engine 1, or a crankshaft of same, not shown. The former 11 is adapted to generate one pulse at a particular crank angle each time the engine crankshaft rotates through 180 degrees, i.e., upon generation of each pulse of the top-dead-center positon (TDC) signal, while the latter 12 is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further electrically connected to the ECU 5 are an atmospheric pressure (PA) sensor 16 and a starter switch 17 for switching on and off a starter, not shown, of the engine, for supplying respective signals indicative of detected atmospheric pressure and on-state or closed and off-state or open positions of the starter switch to the ECU 5.

The ECU 5 operates to calculate the valve opening period TOUT for the main injectors and subinjector of the fuel injection device 6 and supply driving signals corresponding to the calculated TOUT values to the fuel injection device 6 to open the injectors.

Figure 2:
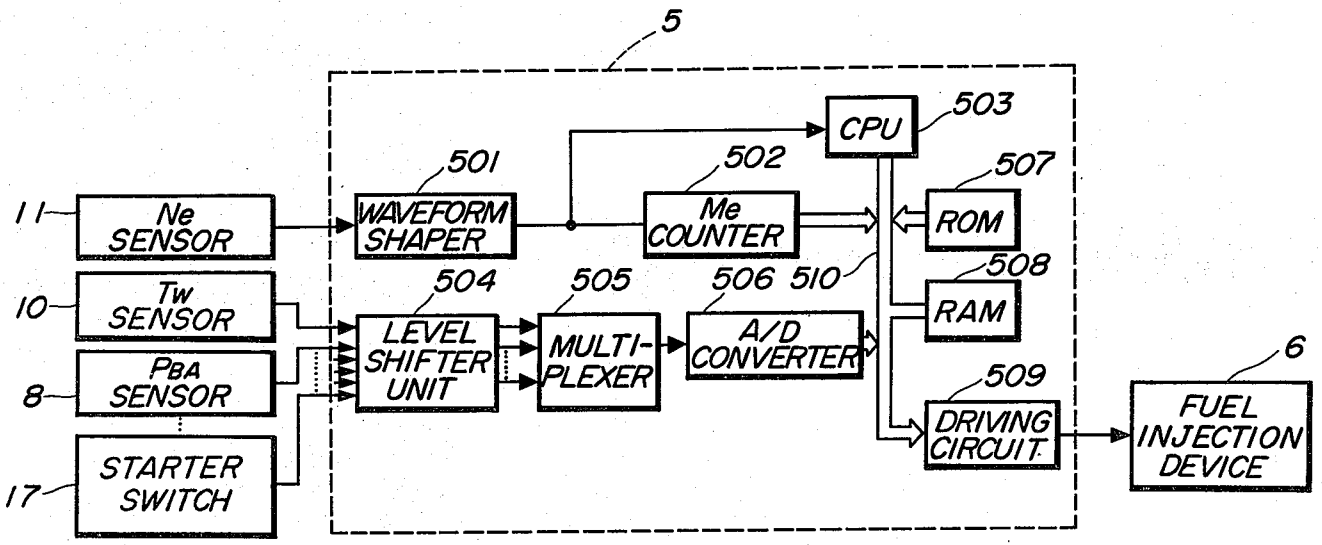
FIG. 2 is a block diagram illustrating the interior arrangement of an electronic control unit (ECU) appearing in FIG. 1.

FIG. 2 shows a circuit configuration within the ECU 5 in FIG. 1. An output signal from the Ne sensor 11 is applied to a waveform shaper 501, wherein it has its pulse waveform shaped, and supplied to a central processing unit (hereinafter called "CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the Ne sensor 11, and therefore its counted value Me corresponds to the reciprocal of the actual engine rotational speed Ne. The Me value counter 502 supplies the counted value Me to the CPU 503 via a data bus 510.

The respective output signals from the intake pipe absolute pressure (PBA) sensor 8, the engine coolant temperature (TW) sensor 10, the starter switch 17, etc. have their voltage levels successively shifted to a predetermined voltage level by a level shifter unit 504 and applied to an analog-to-digital converter 506 through a multplexer 505. The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called "ROM") 507, a random access memory (hereinafter called "RAM") 508 and a driving circuit 509. The RAM 508 temporarily stores various calculated values from the CPU 503, while the ROM 507 stores a control program to be executed within the CPU 503 as well as a table of values of the engine coolant temperature-dependent fuel increasing coefficient KTW and a table of values of the engine coolant temperature-dependent coefficient CAST, both of which are selectively read in manners as hereinafter described, etc. The CPU 503 executes the control program stored in the ROM 507 to calculate the fuel injection periods TOUT for the injectors of the fuel injection device 6 in response to the various engine operation parameter signals, and supplies the calculated period values to the driving circuit 509 through the data bus 510. The driving circuit 509 supplies driving signals corresponding to the above calculated TOUT values to the fuel injection device 6 to drive the injectors of same.

Next, the operation of the fuel supply control system arranged as above will now be described with reference to FIG. 1 referred to hereinabove and FIGS. 3 through 9.

Figure 3:
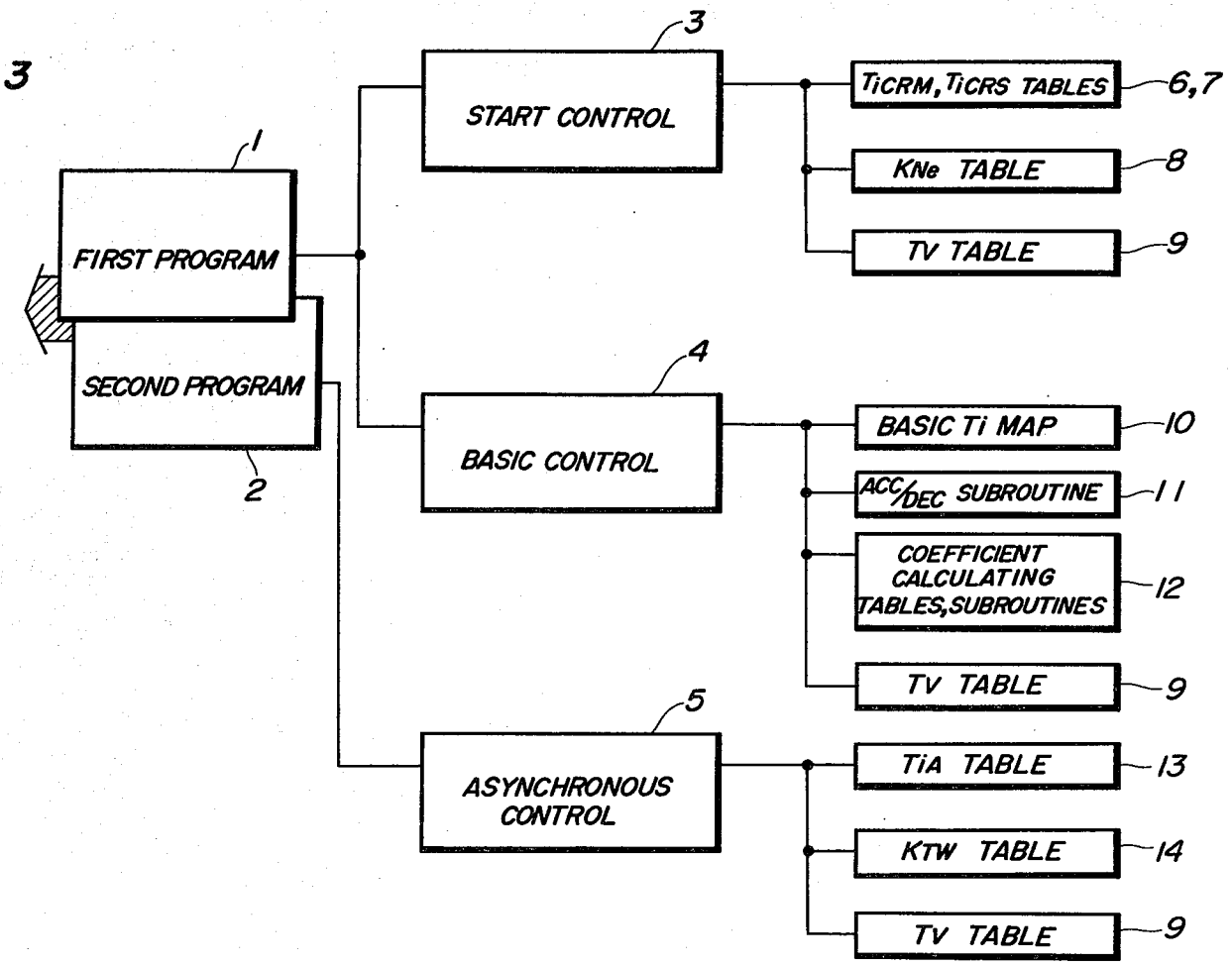
FIG. 3 is a block diagram illustrating a program for control of the valve opening periods TOUTM , TOUTS of main injectors and a subinjector of the engine, which are operated by the ECU in FIG. 1.

Referring to FIG. 3, there is illustrated a block diagram showing the whole program for fuel supply control, i.e. control of valve opening periods TOUTM, TOUTS of the main injectors and the subinjector, which is executed by the ECU 5. The program comprises a first program 1 and a second program 2. The first program 1 is used for fuel quantity control in synchronism with generation of the TDC signal, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a correction value for increasing and decreasing the valve opening period in response to changes in the output voltage of the battery, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = (TiS - TDEC) \times (KTA \times KTW \times KAST \times KPA) + TV \quad (4)$$

where TiM and TiS represent basic values of the valve opening periods for the main injectors and the subinjector, respectively, and are determined from a basic Ti map 10, and TDEC and TACC represent correction values applicable, respectively, at engine deceleration and at engine acceleration and are determined by acceleration and deceleration subroutines 11. KTA, KTW, etc. represent correction coefficients which are determined by their respective tables and/or subroutines 12. KTA is an intake air temperature-dependent correction coefficient and is determined from a table as a function of actual intake air temperature, KTW the engine cooling water temperature-dependent fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ sensor output-responsive feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture.

On the other hand, the valve opening period TMA for the main injectors which is applicable in asynchronism with the TDC signal is determined by the following equation:

$$TMA = TiA \times KTWT \times KAST \times (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 4:
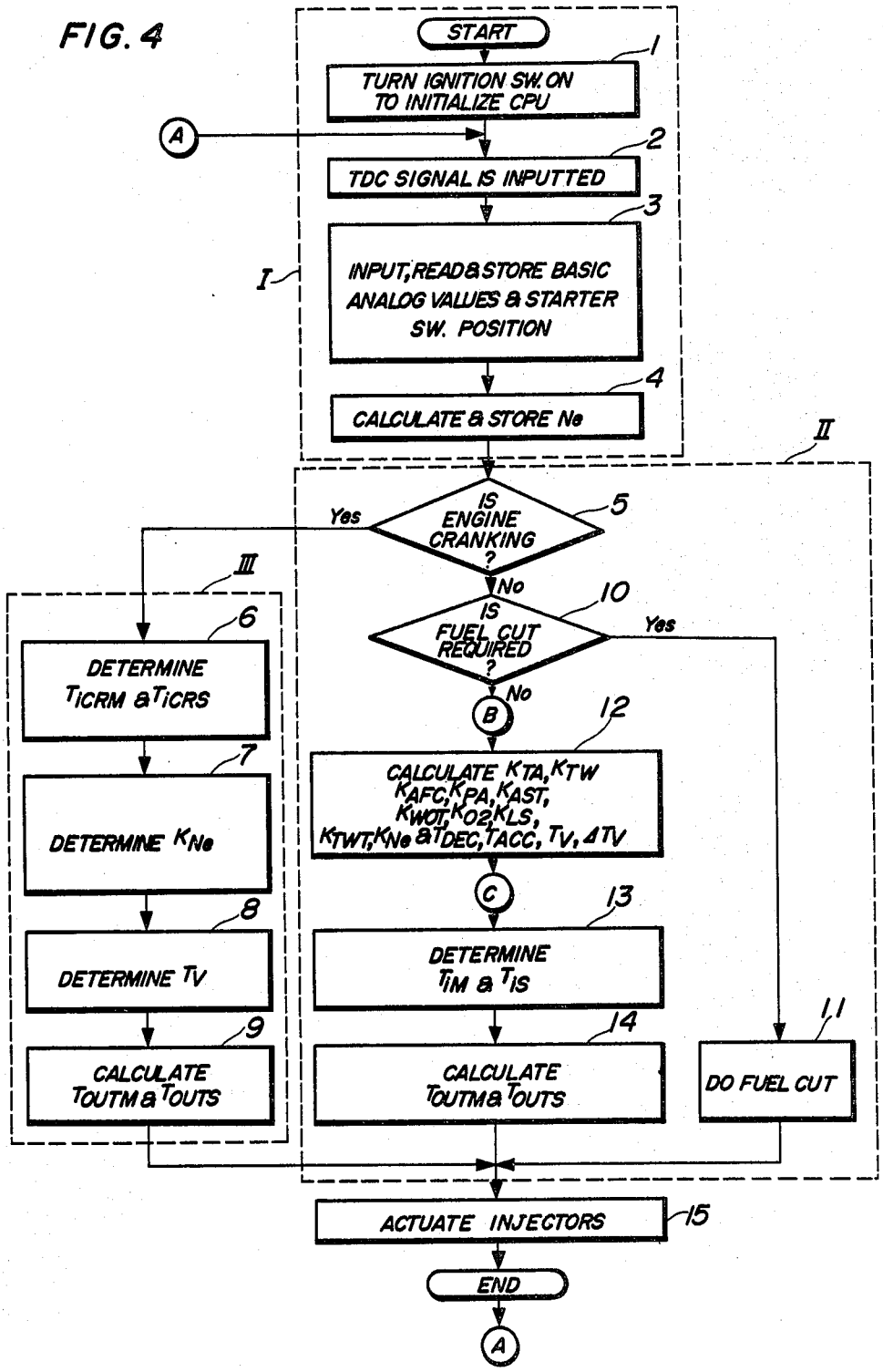
FIG. 4 is a flow chart showing a main program for control of the basic valve opening periods TOUTM, TOUTS.

Referring next to FIG. 4, there is shown a flow chart of the aforementioned first program 1 for control of the valve opening period which is executed by the CPU 503 in FIG. 2 in synchronism with the TDC signal. The whole program comprises an input signal processing block I, a basic control block II and a start control block III. First in the input signal processing block I, when the ignition switch of the engine is turned on, the CPU 503 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, intake air temperature TA, throttle valve opening θTH, battery voltage V, output voltage value V of the $O_2$ sensor and on-off state of the starter switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction value TV is determined by using the TV table (step 8). These determined values are applied to the aforementioned equation (1), (2) to calculate the values of TOUTM, TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and correction values TDEC, TACC, TV, and ΔTV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM, TOUTS on the basis of the values of correction coefficients and correction values selected at the steps 12 and 13, as described above, using the aforementioned equations (3), (4) (step 14). The main injectors and the subinjector are actuated with valve opening periods corresponding to the values of TOUTM, TOUTS obtained by the aforementioned steps 9, 11 and 14 (step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Figure 5:
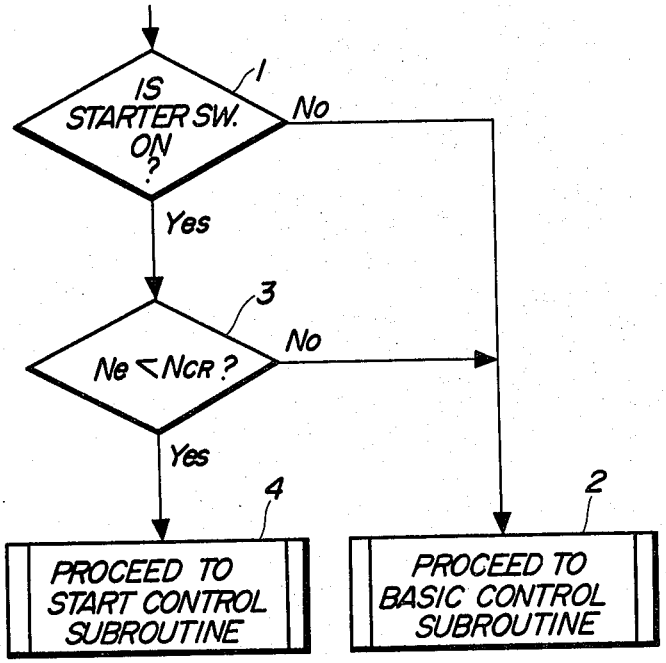
FIG. 5 is a flow chart showing a subroutine forming part of the program of FIG. 4, for determining a cranking state of the engine.

FIG. 5 shows a flow chart of a subroutine for executing the step 5 in FIG. 4 for determining whether or not the engine is in a cranking state. It is first determined at the step 1 whether or not the starter switch 17 in FIG. 1 is in an on or closed state. If the starter switch 17 is not on, it is assumed that the engine is not cranking, and the program proceeds to a basic control loop at the step 2, while if the switch 17 is on, a determination is made as to whether or not the engine rotational speed Ne is lower than a predetermined cranking speed NCR (e.g. 400 rpm), at the step 3. If the former is higher than the latter, the program proceeds to the above-mentioned basic control loop under the assumption that the engine is not cranking, at the step 2, whereas if the former is lower than the latter, the program proceeds to a start control loop (the block III in FIG. 5) under the assumption that the engine is cranking, at the step 4.

Figure 6:
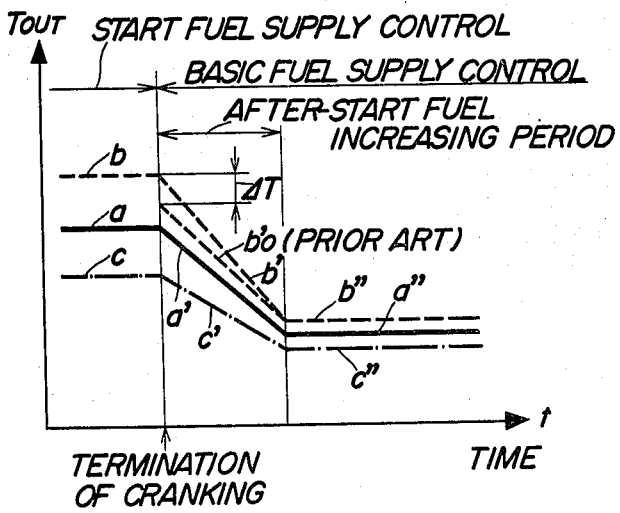
FIG. 6 is a graph showing a manner of increasing the fuel supply quantity immediately after cranking of the engine, according to the method of the invention.

FIG. 6 is a graph showing a manner of increasing the fuel supply quantity immediately after cranking of the engine according to the method of the invention. At the start or cranking of the engine, an increased quantity of fuel which is controlled by the aforementioned starting fuel supply control in a manner dependent upon the engine coolant temperature is supplied to the engine in order to enhance the startability of the engine, as indicated by the solid line a in FIG. 6. During normal operation after the cranking operation, a quantity of fuel which is controlled by the aforementioned basic fuel supply control is supplied to the engine as indicated by the line a″ in FIG. 6. As shown in FIG. 6, there is a difference between the valve opening period level a at cranking and the valve opening period level a″ after cranking. In order to avoid an operating shock of the engine during transition from the cranking operation to the after-cranking normal operation which is caused by the above difference, according to the aforementioned method proposed by the assignee of the present application, the fuel quantity is increased upon entering the transition by multiplying the valve opening period level a″ obtained by the after-cranking basic fuel supply control by a value of the after-start fuel increasing coefficient KAST, and thereafter the value of the same coefficient KAST is gradually decreased in synchronism with generation of pulses of the TDC signal so as to achieve a smooth decrease of the valve opening period or fuel supply quantity from the cranking level a to the after-cranking level a″, as indicated by the line a′ in FIG. 6.

Further, according to the proposed method, the fuel quantity at the start of the engine is set to a higher value as the engine coolant temperature TW is lower. More specifically, when the engine coolant temperature at cranking is lower than that at which the above-mentioned valve opening period level a is obtained, the fuel quantity is set to a value corresponding to a valve opening period level b in FIG. 6, for instance. And, after the cranking is over, the fuel quantity is set to a value corresponding to a valve opening period level b″ obtained by multiplying a valve opening period value determined by the basic fuel supply control by a value of the engine coolant temperature-dependent fuel increasing coefficient KTW. According to the proposed method, during the period of time when the valve opening period shifts from the level b to the level b″ which is hereinafter called "the after-start fuel increasing period", the fuel quantity is gradually decreased along the line b′o so that there occurs a difference in the fuel quantity between at cranking and immediately after the cranking, which corresponds to a valve opening period ΔT. If this difference is large, the driveability of the engine can be spoiled. The reason for the occurrence of such difference ΔT of valve opening period lies in that due to low coolant temperature, the rate of increasing the fuel quantity from the valve opening period level a to the one b at cranking is larger than the rate of increasing the fuel quantity from the valve opening period level a″ to the one b″ by means of the coolant temperature-dependent coefficient KTW after cranking, and further the fuel quantity supplied during the after-start fuel increasing period is set by the use of the fuel increasing coefficient KAST as a product of the coolant temperature-dependent coefficient KTW and the constant CAST′ which has a fixed value, resulting in that the fuel quantity does not coincide with the valve opening period level b immediately upon termination of the cranking operation.

According to the method of the present invention, in place of the above constant or fixed value CAST′, a second coolant temperature-dependent coefficient CAST, the value of which is variable so as to increase as the engine coolant temperature decreases, is employed to set the fuel quantity supplied during the after-start fuel increasing period so as for the fuel quantity to continuously decrease from the valve opening period level b at cranking to the one b'' after cranking along the line b' in FIG. 6.

On the other hand, when the engine coolant temperature is high, the value of the coefficient CAST is set to a smaller value corresponding to the increased coolant temperature to thereby set the fuel quantity so as to continoulsy decrease from the cranking valve opening period level c to the after-cranking one c'' along the line c' as shown in FIG. 6 for smooth shifting to after-cranking operation.

Figure 7:
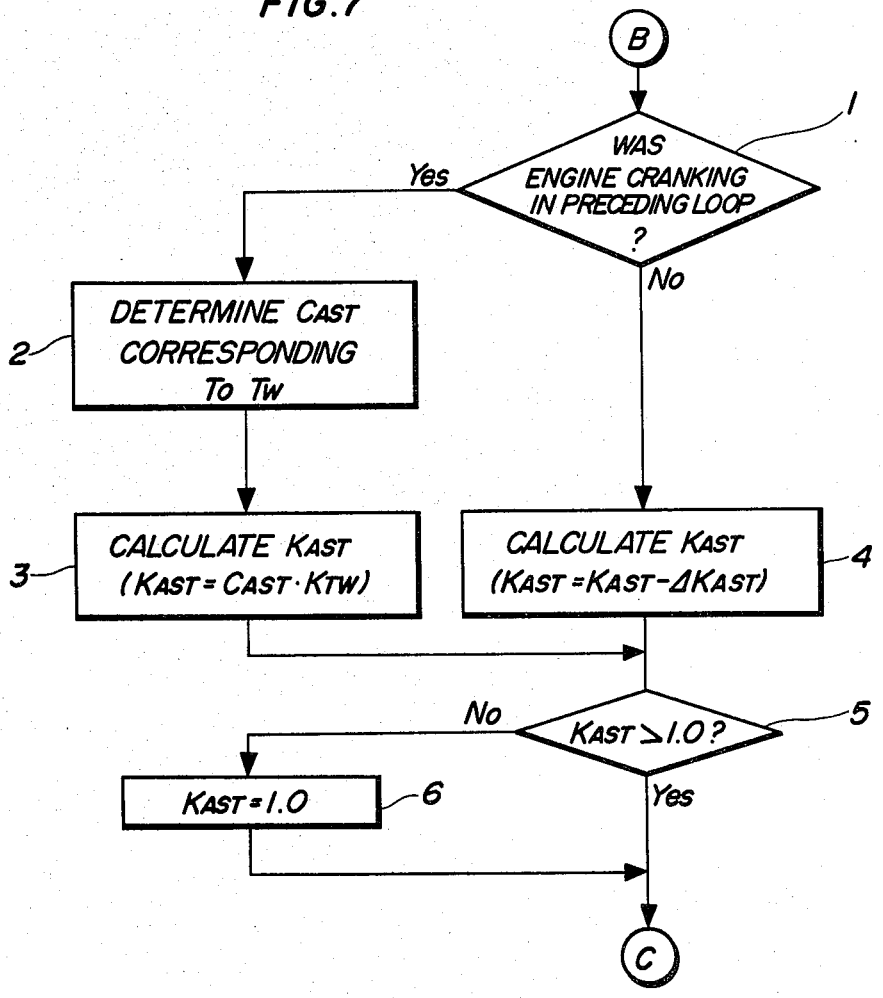
FIG. 7 is a flow chart showing a manner of calculating the value of the after-start fuel increasing coefficient KAST.
Figure 8:
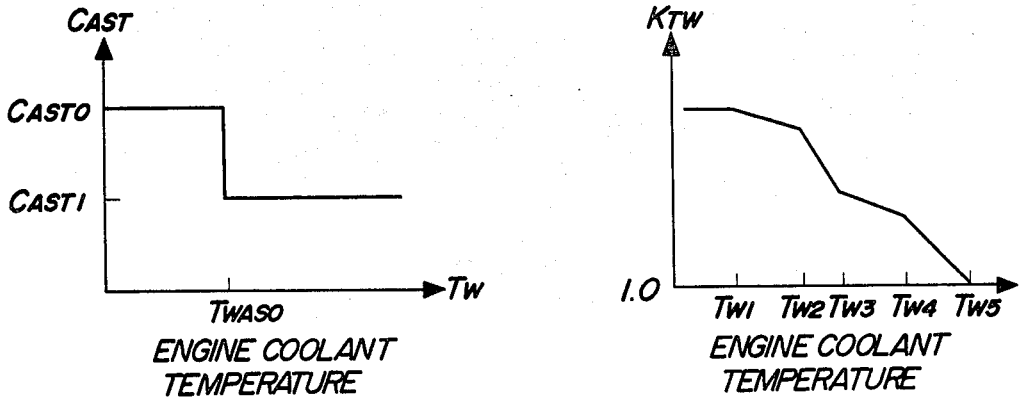
FIG. 8 is a graph showing a table of the relationship between the second cooling water temperature-dependent fuel increasing coefficient CAST applied for calculation of the value of the fuel increasing coefficient KAST and the engine cooling water temperature TW.

FIG. 7 shows a flow chart of a subroutine for calculating the value of the after-start fuel increasing coefficient KAST according to the method of the invention. First, it is determined at the step 1 whether or not the engine was in a cranking state in the last loop of execution of the subroutine. If the engine was cranking, a value of the coolant temperature-dependent coefficient CAST is read from the ROM 507 in FIG. 2 for calculation of the initial value of the after-start fuel increasing coefficient KAST, at the step 2. Shown in FIG. 8 is a table of values of the coefficient CAST set in relation to the engine coolant temperature TW. According to the example of the table, when the engine coolant temperature TW is lower than a predetermined value TWAS0 (e.g. 0° C.), a value CAST0 (e.g. 1.5) is selected as the value of the coefficient CAST, while when the engine coolant temperature TW is higher than the predetermined value TWAS0, a value CAST1 (e.g. 1.2) is selected as the coefficient value. Setting of coefficient values is not limited to that of the illustrated table, but a wide variety of settings are possible in dependence on the operating characteristics of engine to which is applied the method of the invention.

Referring again to FIG. 7, the initial value of the after-start fuel increasing coefficient KAST is calculated on the basis of the value of the coolant temperature-dependent coefficient CAST read at the step 2, by the use of the following equation:

$$KAST = CAST \times KTW \quad (6)$$

where KTW represents the aforementioned coolant temperature-dependent fuel increasing coefficient, the value of which is determined from a table as a function of the engine coolant temperature TW as stated below. FIG. 9 shows a table of values of the fuel increasing coefficient KTW set in relation to the engine coolant temperature TW. According to the table, when the engine coolant temperature TW is higher than a predetermined value TW5 (e.g. 60° C.), the value of the coefficient KTW is held at 1, whereas when the temperature TW is equal to or lower than the predetermined value TW5, five predetermined values of the coefficient KTW are selected as the coolant temperature TW assumes respective five predetermined values TW1-TW5. If the coolant temperature TW assumes a value intervening between adjacent ones of the predetermined values, the value of the coefficient KTW is determined by means of an interpolation method. It is then determined at the step 5 whether or not the value of the fuel increasing coefficient KAST determined as above is larger than 1.0.

When the answer to the step 1 in FIG. 7 is no, that is, if the engine was not cranking in the last loop, the program proceeds to the step 4 wherein a predetermined fixed value ΔKAST is subtracted from a value of the fuel increasing coefficient KAST set in the last loop to set a new value of the fuel increasing coefficient KAST. This predetermined value ΔKAST is set at a value optimal to ensure smooth transition from the starting fuel supply control to the basic fuel supply control. Then, the program proceeds to the step 5 to determined whether or not the newly set value of the coefficient KAST is larger than 1.0. This determination is provided to determine whether or not the after-start fuel increasing period in FIG. 6 has elapsed. When the value of the coefficient KAST is reduced below 1.0 to determine the lapse of the above after-start fuel increasing period, the value of the coefficient KAST is set to 1.0 at the step 6, followed by terminating the execution of the present subroutine.

What is claimed is:

1. A method of electronically controlling the quantity of fuel being supplied to an internal combustion engine in synchronism with generation of pulses of a predetermined control signal, in response to a fuel increment having a value thereof gradually decreasing after termination of cranking of said engine, the method comprising the steps of: (1) determining whether or not said engine is in a cranking state; (2) setting an initial value of said fuel increment, which corresponds to a product obtained by multiplying the value of a fuel increasing coefficient having a value thereof decreasing as the temperature of said engine increases by the value of a coefficient being a function of the temperature of said engine, immediately upon determination that said engine has left said cranking state; (3) subsequently decreasing said set initial value of said fuel increment upon generation of each pulse of said predetermined control signal until the thus decreased incremental value becomes equal to a value at which no substantial increase takes place in the fuel quantity being supplied to said engine.

2. A method as claimed in claim 1, wherein said coefficient as a function of the temperature of said engine has a value thereof increasing as the temperature of said engine decreases.

3. A method as claimed in claim 1, wherein said step (3) includes subtracting a predetermined fixed value from a value of said fuel increment obtained upon generation of each preceding pulse of said predetermined control signal, upon generation of each present pulse of the same signal.

4. A method as claimed in claim 1, further including the steps of detecting whether or not a starter switch provided in said engine is in a closed position or in an open position, and detecting the rotational speed of said engine, and wherein said step (1) comprises determining that said engine is in said cranking state when said starter switch is in said closed position and simultaneously the rotational speed of said engine is lower than a predetermined value.

* * * * *

UNITED STATES PATENT AND TRADEMARK OFFICE

CERTIFICATE OF CORRECTION

PATENT NO. : 4,478,194

DATED : October 23, 1984

INVENTOR(S) : Yamato et al.

It is certified that error appears in the above-identified patent and that said Letters Patent is hereby corrected as shown below:

On the cover page, Item [73], change the name of the assignee to read as follows:

Honda Giken Kogyo Kabushiki Kaisha (Honda Motor Co., Ltd. in English) and Matsushita Electric Industrial Co., Ltd.

Signed and Sealed this

*Fifteenth* Day of *October 1985*

[SEAL]

*Attest:*

*Attesting Officer*

DONALD J. QUIGG

*Commissioner of Patents and Trademarks—Designate*